United States Patent [19]

Olson

[11] 3,982,889

[45] Sept. 28, 1976

[54] PREHEATING SYSTEM FOR ALUMINUM REMELT FURNACE

[76] Inventor: Benjamin F. Olson, 819 W. 22nd St., Suite 2, Tempe, Ariz. 85282

[22] Filed: July 14, 1975

[21] Appl. No.: 595,784

[52] U.S. Cl. ..... 432/128; 432/82; 432/246

[51] Int. Cl.² ..... F27B 9/02; F27D 15/00; F27D 13/00

[58] Field of Search ..... 432/82, 128, 254, 258, 432/246, 254.1, 254.2

[56] References Cited

UNITED STATES PATENTS

| | | | |
|---|---|---|---|
| 1,792,423 | 2/1931 | Hain | 432/82 |
| 3,050,296 | 8/1962 | Trimborn | 432/246 |
| 3,063,878 | 11/1962 | Wilson | 432/82 |
| 3,802,832 | 4/1974 | Nicolaus | 432/128 |

*Primary Examiner*—John J. Camby
*Attorney, Agent, or Firm*—Warren F. B. Lindsley

[57] ABSTRACT

A preheating system for an aluminum remelt furnace, the preheating system extracting hot flue gases from the melting furnace and passing them through cartridges specially designed to hold various forms of aluminum stock in a manner permitting effective transfer of heat from the flue gas.

8 Claims, 7 Drawing Figures

FIG-5
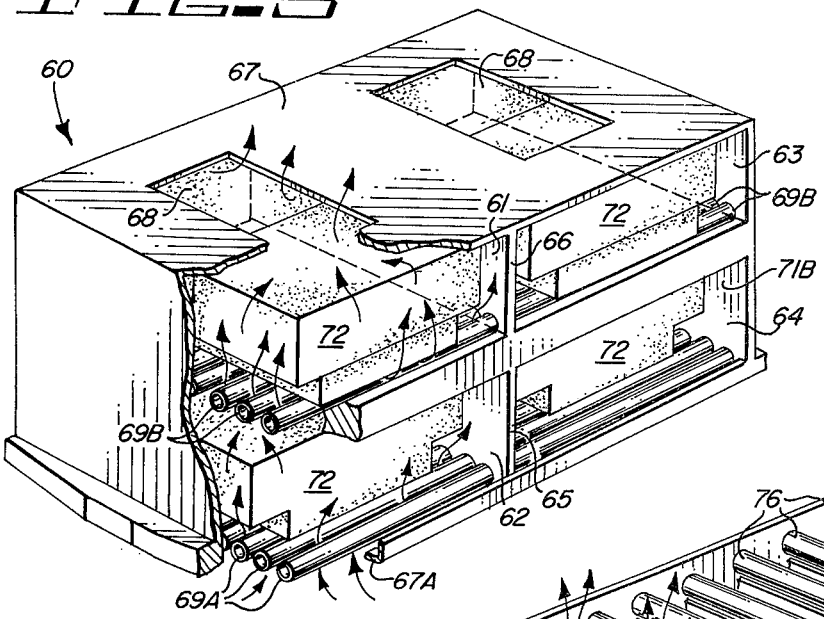
FIG-6
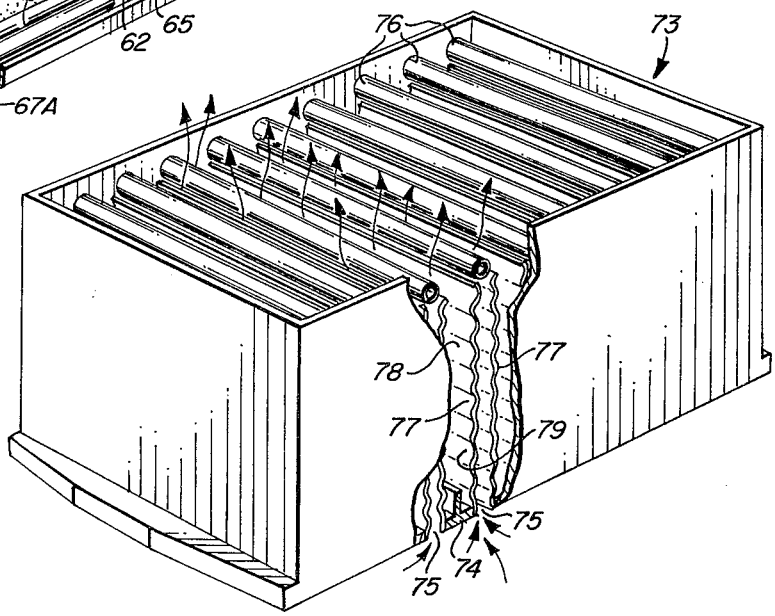
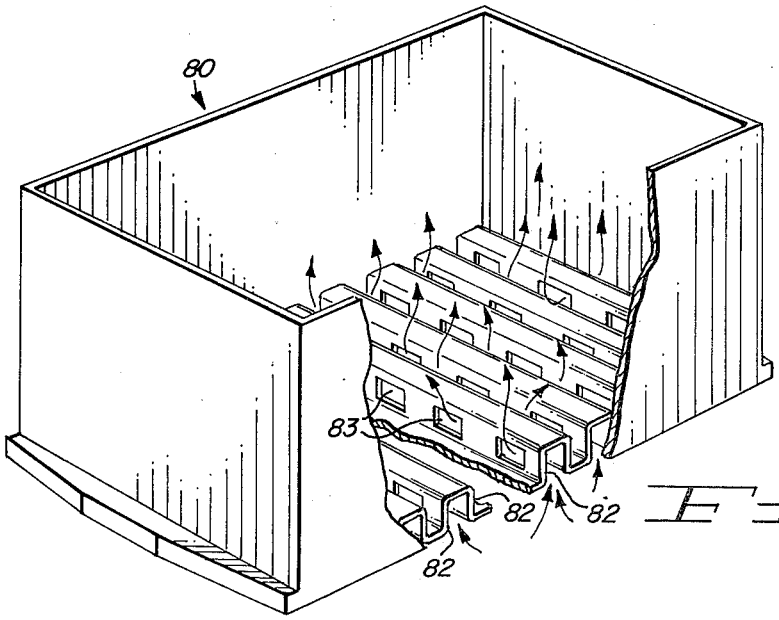
FIG-7

PREHEATING SYSTEM FOR ALUMINUM REMELT FURNACE

BACKGROUND OF THE INVENTION

As the cost of fuels and energy in all forms continues to rise with rapid depletion of supplies, the necessity for energy conservation becomes increasingly apparent and in those industries where operating costs rest heavily on the price of fuel, it is absolutely essential that significant improvements be made in terms of fuel economy. The realization of such improvements will have important effects on the economic health of the nation which has become increasingly dependent upon foreign sources of fuel.

The metal processing industries are heavily involved in this problem because of the large volumes of fuels they consume, and aluminum remelt operations, with which this invention is concerned, provide a significant opportunity for improved utilization of energy resources.

In a typical remelt furnace the exhausted flue gases carry with them large quantities of unused energy in the form of heat. The primary object of this invention is to put this wasted heat energy to work in a preheat stage and thereby to reduce the total amount of energy required for the processing of a given weight of aluminum.

It is estimated that under ideal furnace operating conditions, preheating can produce as much as an 18% to 20% heat rate improvement; in some of the older and less efficient furnace installations, a somewhat higher BTU recovery can be realized even though the percentage in heat rate improvement may be somewhat lower.

Due to the attendant shortening of the remelt cycle, the net reduction in heat required per pound of melt approaches 25% to 32%, undiscounted for non-firing periods.

An additional benefit to be realized through preheating is the increased furnace capacity or throughput per day which results from the reduction in the required melting time per charge. Throughput improvements as high as 55% are possible at a 1450° F. tapping temperature.

SUMMARY OF THE INVENTION

In accordance with the invention claimed, an improved preheating furnace arrangement is provided which is designed for the efficient processing of aluminum stock in various forms.

It is, therefore, one object of this invention to provide a novel aluminum preheating system for a remelt furnace.

Another object of this invention is to provide such a preheating system which effectively and efficiently recovers and utilizes the heat energy that is otherwise lost with exhausted flue gases from the melting furnace.

A further object of this invention is to provide such a system which can conveniently handle a wide variety of aluminum stock ranging from 2000 pound "T" bars to sawdust.

A still further object of this invention is to provide such a system which will significantly reduce the total amount of fuel required to melt a given quantity of aluminum.

A still further object of this invention is to provide such a system which will significantly increase the throughput of a given melting furnace installation.

A still further object of this invention is to provide in such a system a high degree of automation in the interest of reducing human error as well as manpower requirements.

A still further object of this invention is to provide such a preheating system which has a capability to regulate the preheat temperature in a manner appropriate to prevent melting during the preheat cycle while at the same time permitting maximum heat transfer to the aluminum charge.

A still further object of this invention is to provide a set of cartridges, each member of the set being ideally suited to the containment of a particular form of aluminum stock in a manner appropriate for the preheat operation.

A still further object of the invention is to provide in such a preheating system a means for moving the cartridges through the preheating chamber on rollers which are specially mounted in a manner designed to cope with the high operating temperatures present in the chamber.

A still further object of the invention is to provide a means for sealing the preheating chamber against escape of the heating gas if operating under positive pressure or infiltration of air under negative pressure while the cartridges are in place.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which:

FIG. 5 is a perspective view of a cartridge which is specially designed to hold a charge of aluminum ingots and sows during the preheat cycle;

FIG. 6 is a perspective view of a cartridge which is specially designed to hold a charge of aluminum sawdust during the preheat cycle; and FIG. 7 is a perspective view of a cartridge which is specially designed to hold a charge of aluminum scrap during the preheat cycle.

DESCRIPTION OF THE PREFERRED EMBODIMENT

Figure 1:
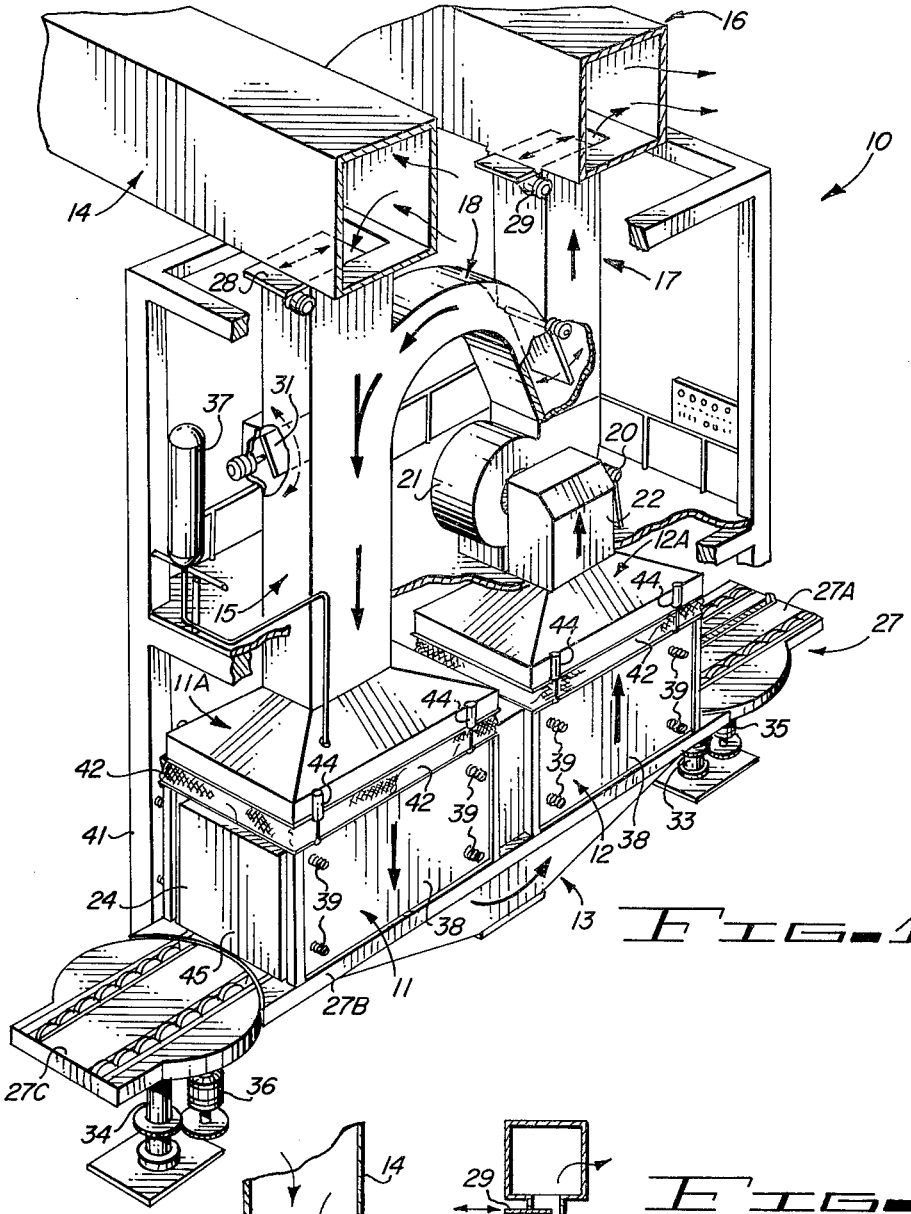
FIG. 1 is a perspective view of the preheat system partially cut away to reveal details of the construction.
Figure 2:
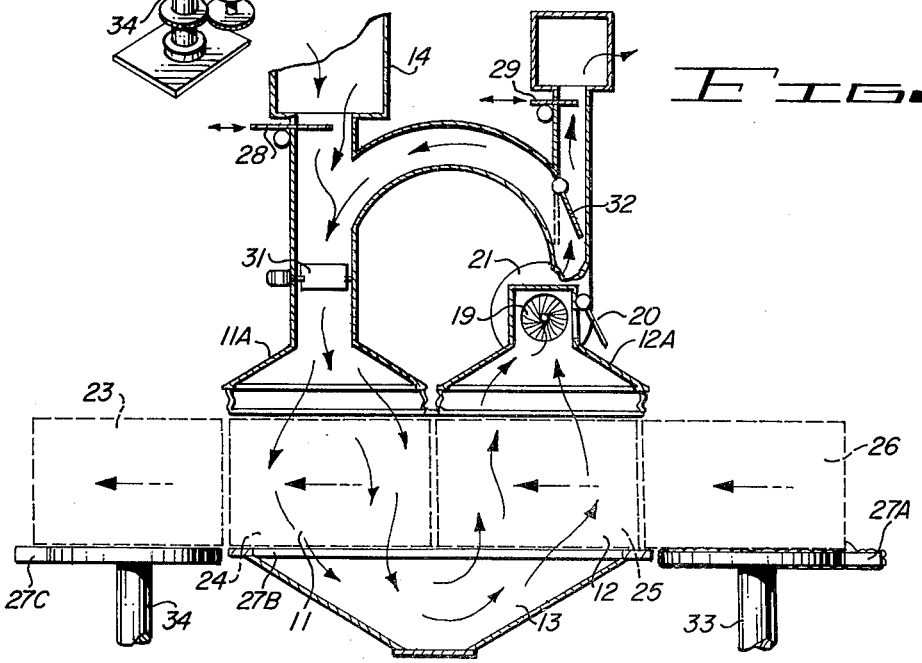
FIG. 2 is a cross-sectional view of the preheat system illustrating the flow paths of the preheat gases and the position and movement of the cartridges which carry the aluminum charge through the system.

Referring more particularly to the drawings by characters of reference, FIGS. 1 and 2 disclose an aluminum preheat system 10 comprising first and second cartridge chambers 11 and 12 topped, respectively, by overhead plenums 11A and 12A and positioned over a common transfer plenum 13, a horizontal flue gas manifold 14 carrying hot flue gas exhausted from the remelt furnace and located directly over the first cartridge chamber 11 and joined thereto by a first vertical manifold 15 which carries hot flue gas from manifold 14 to chamber 11 and a horizontal exhaust manifold 16 positioned directly over the second chamber 12 and joined thereto by a second vertical manifold 17 which carries thermally dissipated flue gas from chamber 12 to manifold 16. A curved recirculation manifold 18 communicates with manifolds 15 and 17 and carries gas from manifold 17 to manifold 15 to be mixed with downwardly flowing higher temperature flue gas from manifold 14 to provide a desired reduction in the temperature of the gas mixture entering chamber 11. A centrifugal fan 19 and associated cowling 21 and intake plenum 22 are mounted for intake from plenum 12A and exhaust into manifolds 17 and 18. Fan 19 produces a differential pressure head between manifold 17 and manifold 15 and in chambers 11 and 12 with pressure gradients appropriate to draw hot flue gas from manifold 14 along with recirculated gas from manifold 18 downwardly through manifold 15, plenum 11A and chamber 11 and from there through plenum 13 and upwardly through chamber 12, plenum 12A, intake plenum 22, cowling 21 and fan 19. A portion of the flue gases passes into manifold 18 and the remainder through manifold 17 and into exhaust manifold 16.

Cartridges 24, 25 and 26 are moved into and through chambers 11 and 12 by a chain driven conveyer 27 integral in the feed table section 27A. This conveyor 27 moves cartridge 26 which pushes against cartridge 25 which pushes against cartridge 24 to index those three cartridges precisely one cartridge length per stroke. Cartridge 23 must have been removed prior to the indexing. A central section 27B and a discharge table section 27C consists of non-powered rollers.

A set of automatically controlled dampers are employed including a first guillotine damper 28 located at the top of manifold 15, a second guillotine damper 29 located at the top of manifold 17, a first rotating vane damper 31 located at an opening in the side of manifold 15, and a second rotating vane damper 32 located at the junction of manifolds 17 and 18 and a third rotating vane damper 20 located in the side of manifold 22.

Solid line arrows shown in FIGS. 1 and 2 define the gas flow paths described while the broken line arrows indicate movement of the cartridges 23, 24, 25 and 26 through chambers 11 and 12. In the operating cycle of system 10, cartridges 23, 24, 25 and 26 are moved in steps through chambers 11 and 12, each being moved from feed table conveyer section 27A into chamber 12 where it remains for a first preheat period. Then, it is moved into chamber 11 for a second preheat period before being ejected to discharge conveyer section 27C.

As each cartridge and its aluminum charge is indexed through chambers 12 and 11 in that order its initially cold charge is first exposed to a relatively low temperature gas in chamber 12 and then the partially heated charge is exposed to a relatively higher temperature gas in chamber 11. The flow of gas passing first through chamber 12 and then at reduced temperature through chamber 11 constitutes in effect a counter flow system which produces and maintains appropriately balanced temperature heads between heating gas and aluminum charge in the two chambers.

The dampers 28, 29, 31, 32 and 20 are automatically controlled by means of strategically located temperature sensors to control operating temperatures and gas velocity within the chambers 11 and 12 throughout the pre-heat cycle. It is important, for example, that the gas temperature in either chamber shall not exceed the softening temperature of aluminum so that pieces of scrap or other stock will not fuse together or become wedged inside the cartridges. The maximum temperature must therefore be held below approximately 1100° F. At the same time, the temperature should be maintained as high as possible for maximum heat transfer to the aluminum.

To maintain the desired temperature level entering chamber 11, damper 32 is operated to direct cooled flue gas in maximum quantity to blend with the hotter flue gas coming from manifold 14. Damper 28 will move to alter the inflow of hot gas as necessary to control the blend temperature. When the fan 19 maximum capacity to deliver flue gas to manifold 15 against the prevailing system head resistance is reached, damper 31 will open if necessary to blend ambient air into the gas to achieve the desired gas temperature entering chamber 11.

Damper 12 is provided to introduce ambient air into the flue gas entering fan 19 in such quantity as necessary to keep from exceeding the design temperature limit of the fan.

It is apparent that the total supply of heat energy available to the preheater is the sensible heat in the flue gas taken from manifold 14 as controlled by dampers 28 and 32. At the same time, for maximum heat transfer rate to the aluminum charge, the gas mass flow through chambers 11 and 12 must be maintained at high level. By employing recirculation of flue gas this is achieved and can be varied to suit the geometry, draft resistance, and temperature levels of the in-heater aluminum charges.

The feed table and the discharge table 27C are mounted on rotatable pedestals 33 and 34. Rotation of pedestals 33 and 34 is accomplished by means of motors 35 and 36, respectively. These tables may also be a non-moveable type, i.e. to suit the cartridge delivery and removal system.

A $CO_2$ bottle 37 is mounted on the preheater support structure with a tube running from bottle 37 to inside plenum 11A. In the event a fire erupts inside chamber 11, fan 19 is automatically de-energized, dampers 28 and 29 are automatically closed to seal off manifolds 14 and 16, vane 20 opens and $CO_2$ is discharged into chamber 11 to extinguish the fire. Such fires will occasionally result when magnesium scrap is inadvertently moved into the preheat chambers.

Figure 3:
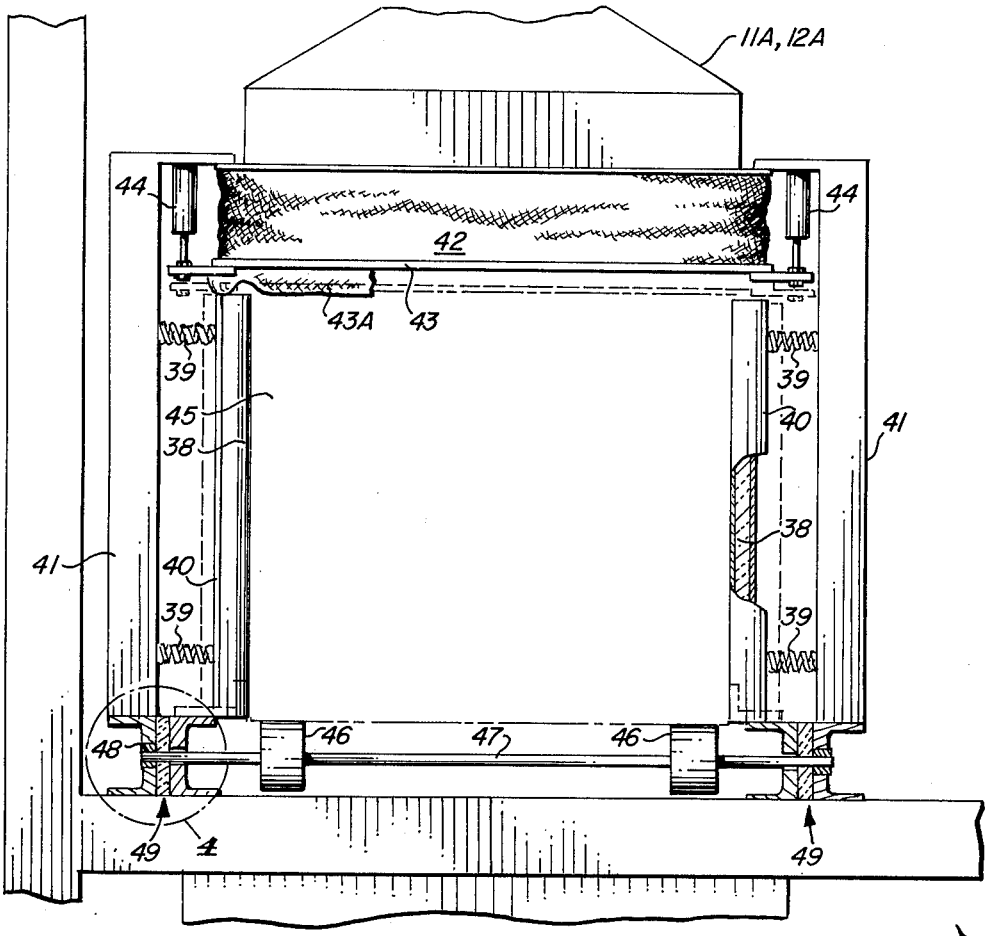
FIG. 3 is an end view of a cartridge shown in position in the preheat chamber.
Figure 4:
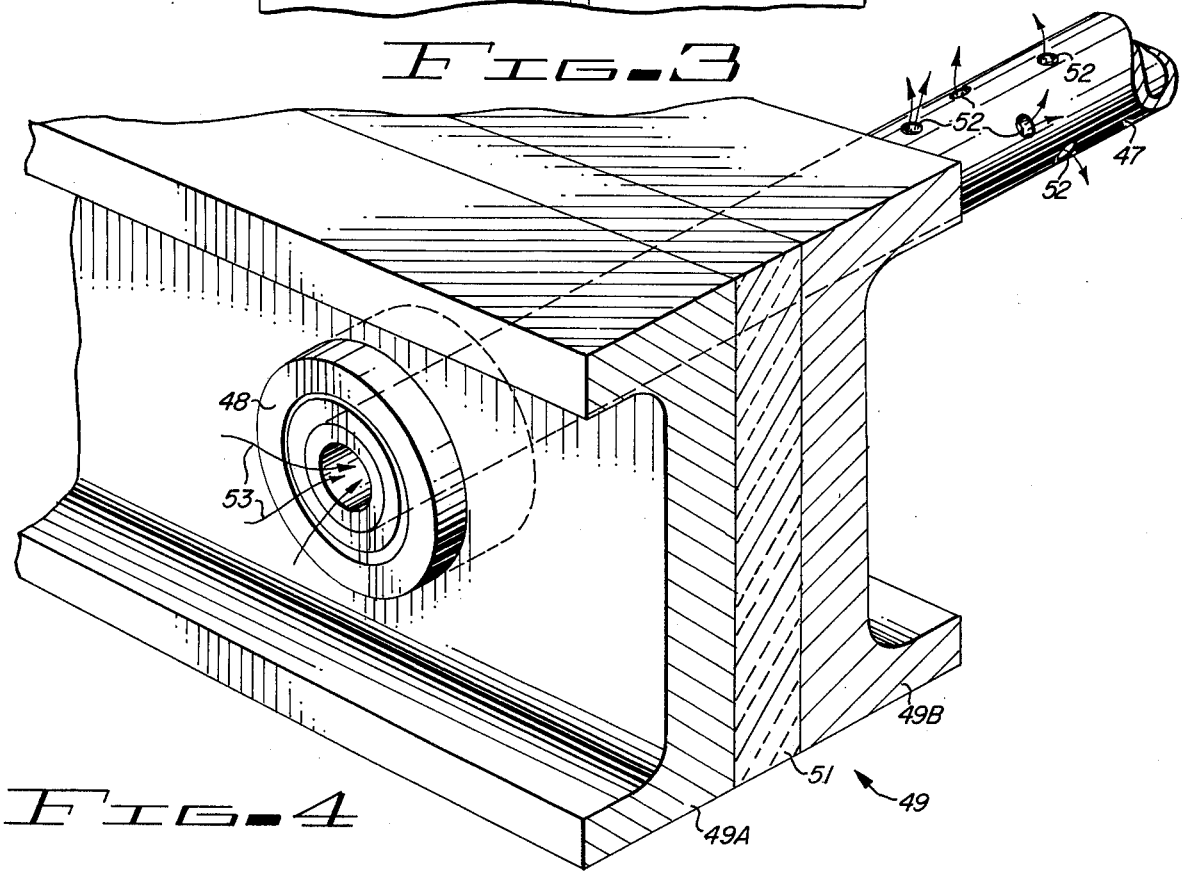
FIG. 4 is a detailed perspective view of the special roller and bearing construction which supports the cartridge as it is moved through the preheat chamber.

FIGS. 3 and 4 illustrate details of chambers 11 and 12 and their special design features which permit sealing openings between the edges of cartridges 24 and 25 and chambers 11 and 12 during preheat periods while facilitating the movement of the cartridges therethrough.

Chambers 11 and 12 are rectangular in shape and are closed on their sides by spring-loaded side plates 38. The ends of the chambers which receive the cartridges are open. Four compression springs 39 located one near each corner of each of the plates 38 are aligned horizontally perpendicular to the face of plate 38. Each spring is attached at one end to the face of plate 38 and at the other end to a vertical structural member 41 and urge plates 38 inwardly against the sides of the cartridge 24 or 25. The vertical edges 40 of plates 38 are flared outwardly so that they are forced apart to receive the cartridges as they move into chamber 12 from conveyer section 27A. The vertical side walls of some of the cartridges are of open construction and the spring loaded plates 38 thus serve to close the sides of the cartridges during the preheat cycle.

A substantially gas-tight seal is formed around the top edges of chambers 11 and 12 by flexible accordion type steel curtains 42. These curtains completely surround the top edges of chambers 11 and 12 with the top edges of the curtains attached to the lower edges of plenums 11A and 12A and the bottom edges of the curtains attached to rectangular frames 43 on the bottom of which is a soft material 43A that deforms against the cartridge to form a relatively gas tight seal. Each frame is supported by four pneumatic lifters 44 attached to the sides of plenum 11A or 12A. After moving the cartridges into and out of chambers 11 and 12, frames 43 are automatically lowered to form a seal around the top edges of the cartridges. The ends 45 of the cartridges are closed and require no additional barriers.

Conveyer 27 utilizes a series of rollers 46, the rollers 46 fixedly attached to specially cooled hollow cylindrical axles 47 transversely oriented along the length of conveyer 27. Each axle is supported at each of its ends by bearings 48 mounted outside of chambers 11 and 12 in a position where they are not exposed to the high temperatures present inside the chambers.

Running lengthwise along each side of conveyer 27 is a bearing support structure 49 comprised of two steel channels 49A and 49B positioned back to back with the channels opening outwardly and separated by a thick insulating sheet 51. Sheet 51 reduces heat flow horizontally through structure 49, and more particularly through channels 49A and 49B. Channels 49A and 49B are thus rendered substantially isothermal so that warpage due to temperature gradients are minimized as required for the proper support of bearings 48 and axles 47. Clearance holes for axle 47 are provided through channels 49A and 49B and through sheet 51.

Cooling of axles 47 and hence also bearings 48 is accomplished in one of two ways; the first as illustrated in FIG. 4 is accomplished simply through the introduction of a multiplicity of holes 52 bored into the walls of the axle which permit cooling air 53 to be drawn into the open ends of the axle and through the holes into chamber 11 or 12. The flow of air just described is induced by the negative pressure head existing inside chamber 11 or 12. An alternate approach for cooling axles 47 and bearings 48 is simply to force cooling air through the hollow axles 47 with the aid of a special external fan or pressure system. In this case, there would be no holes 52 in axle 47.

FIGS. 5, 6 and 7 illustrate three different versions of the cartridges. Each of the cartridges illustrated in FIGS. 5–7 is designed to hold a different form of aluminum stock and in the preferred embodiment, each is approximately 8 feet long, 6 feet wide and 4½ feet high.

Cartridge 60 of FIG. 5 is designed to hold aluminum ingots in the form of 2000 pound T-bars or 400 pound sows. There are four individual compartments 61, 62, 63 and 64. Each compartment holds one T-bar or two sows. The two compartments 62 and 64 are located on a lower level and are separated by a solid vertical wall 65; the other two compartments 61 and 63 are located on an upper level and are separated by a solid vertical wall 66. The top of the upper compartments are covered by a flat plate 67 which is closed except for a rectangular opening or window 68 centered over each of the compartments 61 and 63. An identical plate 67A covers the bottom of the cartridge 60 and another plate 67B separates the lower compartments 62 and 64 from the upper compartments 61 and 63. Located just above the lower plate 67A is a grid of hollow bars or pipes 69A running longitudinally of the cartridge and are supported by wall 65 in the center of the cartridge and by the solid end walls 71A and 71B. A second identical grid of pipes 69B is supported in the same manner just above center plate 67B.

The sides of the cartridge are open to permit the loading of the ingots 72 and are covered inside the chambers 11 and 12 by the spring loaded side plates 38. The flow of heating gas through cartridge 60 enters through windows 68 in bottom plate 67A, spreads out around and over the tops of the ingots 72 in compartments 62 and 64 and then moves up through windows 68 in center plate 67B, out, around and over the surfaces of the ingots 72 in compartments 61 and 63 and out through window 68 in upper plate 67. If cartridge 60 is located in chamber 11, the flow is in the opposite direction, i.e., downwardly rather than upwardly. As the foregoing description illustrates, the special construction of cartridge 60 optimizes heat absorption by the ingots by causing the gases to wash over a greater part of the surface areas of the ingots as it passes through cartridge 60.

Cartridge 73 of FIG. 6 is designed to hold aluminum sawdust for preheating in system 10. Cartridge 73 is closed on all four vertical sides. A grid of cross-members 74 each having a cross-section similar to an inverted T extends across the bottom of the cartridge, the T's running transversely to the length of the cartridge leaving between each pair of adjacent cross-members 74 an open slot 75. A horizontal grid of pipes 76 again are oriented transversely to the length of the cartridge with each pipe being centered over one of the slots 75. From each of the two edges of each of the slots 75, a vertical corrugated metal panel 77 rises to a point just below the aligned pipe 76. The panels form over each of the cross-members 74 a tall thin column 78 closed at the bottom for the containment of the sawdust charge. At the same time, a gas passage 79 is also formed by the panels 77 over the slots 75, the gas passing through slot 75, upwardly between panels 77 and out around pipe 76. The function of pipes 76 in addition to stiffening the cartridge is to prevent the sawdust from falling through passages 79 while it is being loaded into columns 78.

Cartridge 80 of FIG. 7 is designed to hold aluminum scrap of random shapes. Cartridge 80 is closed on all four vertical sides and is open on the top. The bottom 81 is in a corrugated form, the corrugations being formed entirely by right angle breaks which leave a series of vertical walls 82 along the length which form equally spaced rectangular openings 83. When cartridge 80 is loaded with scrap and installed in chamber 12, the gas enters cartridge 80 through the openings 83, spreads out along the channels in the corrugated bottom 81 and filters upwardly through the scrap aluminum transferring heat to the aluminum charge.

In accordance with the objects of the invention, a novel and effective preheat system is disclosed for an aluminum remelt furnace. It will be recognized that the same principles and a similar construction is applicable to preheating systems for other materials and processes and while but a single embodiment of the invention has been illustrated and described, it will be apparent to those skilled in the art that various changes and modifications may be made therein without departing from the spirit of the invention or from the scope of the appended claims.

What is claimed is:

1. A preheating apparatus for a metal remelt furnace comprising:

first and second juxtapositioned chambers, a conveyor system for moving metal containing cartridges sequentially through said chambers, a duct system for conveying exhaust gases from a source of heat sequentially through said first and second chambers, duct means for recirculating a part of the exhaust gases passed through said second chamber back to a portion of said duct system leading into said first chamber, fan means within said duct system downstream of said second chambers for drawing the gases through said first and second chambers, and damping means within said duct system for controlling the amount of hot gases recirculating through the apparatus and cooling air drawn into the apparatus from the atmosphere, said chambers being open ended so that when a pair of cartridges are moved into the chambers opposite ends of the cartridges close opposite ends of the chambers with juxtapositioned ends of the chambers being interconnected with a part of said duct system.

2. The preheating apparatus set forth in claim 1 in further combination with:

first and second plenums, one of said plenums being provided for each of said chambers, said duct system being provided with a pair of manifolds, one of said manifolds being connected to the plenum of said first chamber for conducting hot gases to said first chamber and the other of said manifolds being connected to the plenum of said second chamber for conducting the hot gases away from said second chamber.

3. The preheating apparatus set forth in claim 2 in further combination with:

flexible means provided for connecting the plenums to each of the chambers.

4. The preheating apparatus set forth in claim 1 wherein:

the chambers are each provided with a pair of side walls which are resiliently mounted and biased inwardly to hug the cartridges as they move into and while remaining in said chambers.

5. The preheating apparatus set forth in claim 2 wherein:

said chambers are provided with a common plenum for transferring the hot gases having passed through said first chamber to and through said second chamber, said common plenum being mounted on the opposite side of said chambers from the mounting of said first and second plenums.

6. The preheating apparatus set forth in claim 1 wherein:

said conveyor is provided with a plurality of rotatable axles mounted within said chambers for moving the cartridges therethrough, and bearing means for each of said axles, said bearing means being mounted outside of said chamber.

7. The preheating apparatus set forth in claim 1 in further combination with:

at least two cartridges for sequentially moving through said chambers, each of said cartridges being provided with gas passageways therethrough for conducting gases from said duct system through the contents of said cartridges.

8. The preheating apparatus set forth in claim 7 wherein:

said passageways of said cartridges form a part of said duct system from the plenum of said first chamber, through said first chamber, said common plenum, said second chamber, and the plenum of said second chamber.

* * * * *